United States Patent [19]

Hong

[11] Patent Number: 4,963,183

[45] Date of Patent: Oct. 16, 1990

[54] CORROSION RESISTANT CEMENTED CARBIDE

[75] Inventor: Joonypyo Hong, Rochester Hills, Mich.

[73] Assignee: GTE Valenite Corporation, Troy, Mich.

[21] Appl. No.: 318,865

[22] Filed: Mar. 3, 1989

[51] Int. Cl.[5] ..... C22C 29/02

[52] U.S. Cl. ..... 75/241; 428/539.5

[58] Field of Search ..... 428/539.5; 75/241

[56] References Cited

U.S. PATENT DOCUMENTS

| | | | |
|---|---|---|---|
| 3,235,346 | 2/1966 | Hucke | 428/539.5 |
| 3,756,787 | 9/1973 | Lange et al. | 182/182 |
| 3,762,919 | 10/1973 | Daniels | 204/213 |
| 3,771,975 | 11/1973 | Frehn | 75/236 |
| 3,889,348 | 6/1975 | Lemelson | 428/539.5 |
| 3,918,924 | 11/1975 | Shibata | 29/182.8 |
| 3,993,446 | 11/1976 | Okawa | 29/182.7 |
| 4,265,662 | 5/1981 | Miyake et al. | 75/238 |
| 4,397,889 | 8/1983 | Benjamin et al. | 427/221 |
| 4,497,660 | 2/1985 | Lindholm | 240/236 |
| 4,514,224 | 4/1985 | Nishigaki | 75/238 |
| 4,684,405 | 8/1987 | Kolaska | 240/241 |
| 4,698,884 | 10/1987 | Evans | 29/132 |
| 4,726,842 | 2/1988 | Reeve et al. | 75/244 |

OTHER PUBLICATIONS

WC-(Ni,Co,Cr) Cemented Carbide, Ekemar et al. (Sweden) "Nickel as a Binder in WC-Based Cemented Carbides".

*Primary Examiner*—Stephen J. Lechert, Jr.
*Assistant Examiner*—Leon Nigohosian, Jr.
*Attorney, Agent, or Firm*—Robert E. Walter

[57] ABSTRACT

A corrosion resistant cemented carbide composite constitutes from about 2 to about 30 percent by weight metal binder and from about 70 to about 99.5 percent by weight metal carbide wherein the metal carbide comprises about 2 to about 80 percent by weight of a transition metal carbide or mixtures thereof selected from Group IVB and Group VB of the Periodic Table of Elements and from about 20 to about 98 percent tungsten carbide. The metal binder phase comprises a major portion by weight nickel and from about 5 to about 30 percent by weight chromium. The cemented carbide composite comprises a granular tungsten carbide phase, a semi-continuous solid solution carbide phase extending closely adjacent at least a portion of the grains of tungsten carbide for enhancing corrosion resistance, and a substantially continuous metal binder phase.

11 Claims, 1 Drawing Sheet

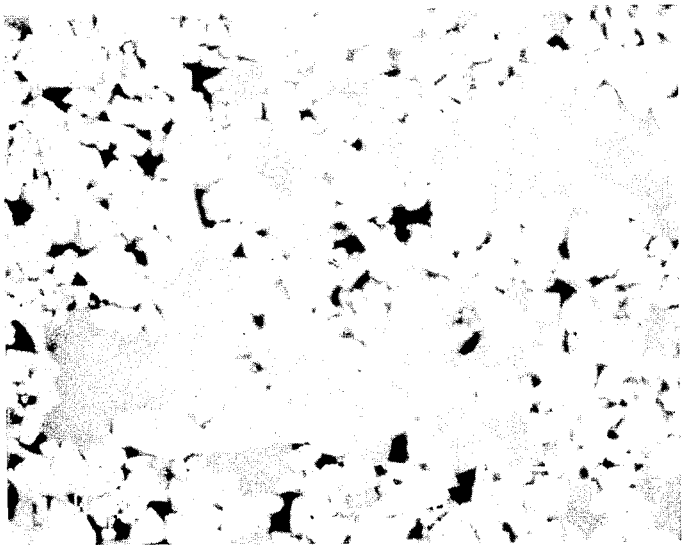
FIGURE: TYPICAL MICROSTRUCTURE, X8000
( SEM MICROGRAPH )

CORROSION RESISTANT CEMENTED CARBIDE

BACKGROUND OF THE INVENTION

The present invention relates to corrosion resistant cemented carbide bodies and more specifically to cemented metal carbide bodies that are resistant to acids and bases.

For certain applications, it is desirable for cemented carbide tools and wear parts be resistant to a corrosive environment and, in particular, be able to withstand the attack of strong acids and bases such as sulfuric acid, hydrochloric acid and sodium hydroxide. A cemented carbide having a nickel binder is typically used for these applications U.S. Pat. No. 4,497,660 to Lindholm relates to a corrosion resistant cemented carbide material having a relatively small content of cubic carbides at about the range of conventional C2 grade cemented carbide which is a general wear grade. The Lindholm patent describes a nickel alloy binder containing chromium, molybdenum manganese and other specific additional ingredients such as copper, aluminum, or silicon to "keep the W-concentration of the binder phase low and to avoid the formation of brittle, undesirable phase."

SUMMARY OF THE INVENTION

A problem encountered with cemented carbides having a nickel binder or matrix is high porosity due to the difficulty of sintering these materials. This is a particular problem with nickel-chrome alloy binders. The presence of pores or voids can cause structural weakness leading to crack initiation. It is an object of the present invention to achieve better control over porosity and reduce the problems associated with sintering corrosion resistant cemented carbide compositions and, thereby, enhance the mechanical properties of the substrate.

When sintering relatively large pieces of cemented carbides using graphite trays, localized grain growth and increased carbon content is frequently observed near the bottom of the piece. It is an object of the present invention to achieve a more uniform product by inhibiting grain growth, even in conditions of high carbon.

In cemented carbide compositions, the metal matrix phase which is generally a continuous phase is typically more vulnerable to corrosion than the metal carbide phase. It is a further object of the present invention to achieve a less continuous skeleton of metal binder or matrix so as to enhance the corrosion resistance propertie of the composition.

In accordance with the present invention, there is provided a corrosion resistant cemented carbide composite comprising from about 2 to about 30 percent by weight metal binder phase and being constituted from about 70 to about 98 percent by weight metal carbide. The preferred microstructure of the composite comprises a granular tungsten carbide phase, a semi-continuous solid solution carbide phase extending closely adjacent at least a portion of the grains of tungsten carbide for enhancing corrosion resistance, and a substantially continuous metal binder phase. The metal carbide comprises about 2 to about 80 percent by weight of a transition metal carbide or mixtures thereof selected from Group IVB and Group VB of the Periodic Table of Elements and from about 20 to about 98 percent tungsten carbide. The matrix metal comprises a from about 5 percent to about 30 percent by weight chromium with the remaining portion comprising nickel. The sintered composite of the present invention may include an effective amount of an additive for enhancing the uniformity of the corrosion resistance of the composite body.

BRIEF DESCRIPTION OF THE DRAWING

The only FIGURE is an micrograph illustrating the microstructure of a composition of the present invention under a scanning electron microscope at a magnification of eight thousand times.

PREFERRED EMBODIMENTS

The only FIGURE illustrates the microstructure of a typical composition of the present invention. The black portion shown as 1 is the metal binder or matrix phase which is believed to be a substantially continuous phase between the grains of tungsten carbide which are shown in white as reference number 2. The solid solution carbide phase which is gray is shown as reference number 3. In accordance with the principles of the present invention, the solid solution carbide phase 3 behaves somewhat like a metal matrix or binder in filling between tungsten carbide grains 2 and reducing porosity. The solid solution carbide phase 3 has tentacles or fingers 4 extending at least partially through the composite. The tentacles or fingers 4 which are irregularly shaped projections having a random orientation are believed to extend closely adjacent the tungsten carbide grains 2 replacing at least a portion of the metal matrix 1 which is normallY found in this closelY adjacent position.

The wear resistant composition of the present invention preferably is constituted from about 70 to about 98 percent, and preferably from about 84 to about 96 Percent by weight metal carbide based on the total weight of the composite. The term constituted means generally as comprised based on the final sintered composition as analyzed by ordinary analytical techniques and based on the starting powders utilized to make the sintered composite. The metal carbide comprises a transition metal carbide or mixtures selected from Group IVB, Group VB, and Group VIB of the Periodic Table of Elements.

From about 20 to about 98, and preferably from about 50 to about 96 percent by weight of the metal carbide comprises tungsten carbide which is typically used in its hexagonal form. The major portion of tungsten carbide is present as the granular phase 2 in the final sintered material but lesser amounts are present in the solid solution carbide phase 3 due to the solubility of tungsten carbide. From about 2 to about 80, and preferably from about 4 to about 50 percent by weight of the metal carbide comprises transition metal carbides or mixtures thereof selected from Group IVB and Group VB of the Periodic Table of Elements. Because of their cubic crystal structure, these metal carbides form a solid solution with tungsten carbide which is present in the final composite after sintering. The resulting solid solution carbide forms a semi-continuous phase which is evident from a photographic sample of a polished cross section of a composite of the present invention. Preferably the cubic metal carbide is present in an amount sufficient to inhibit grain growth during sintering even under conditions of high carbon and to promote the formation of the semi-continuous solid solution carbide phase. Additional metal carbides including the carbides of molybdenum and chromium may be present in the final composite and in particular in the solid solution carbide phase.

A typical corrosion agent such as aqueous acids and bases tend to follow the path of the matrix material in a cemented carbide. In the present invention, the formation of the semi-continuous phase acts as a barrier to the corrosion agent. The tentacles or fingers are believed to form areas which tend to block the corrosive attack of the composite from corrosion agents such as acids and bases. It is believed that the solid solution carbide reduces the continuous skeleton of metal matrix and blocks the corrosive attack of the composite from corrosion agents. It is also believed that the cubic carbide phase enhances the density or desirably enhances the reduction of porosity in carbides cemented with a nickel binder.

The matrix metal comprises a from about 5 percent to about 30 percent by weight chromium with the remaining portion comprising nickel. A preferred range of chromium is from about 10 to about 25 percent by weight based on the total weight of the matrix phase. The matrix metal may contain additional intentional or unintentional alloying agents. Small amounts of alloying metals may be present from the iron group metals which, in addition to nickel, include cobalt and iron. Cobalt and iron may be present only to the extent that they do not deleteriously affect the corrosion resistant properties of the present invention. Typical additional alloying agents include molybdenum, tungsten, and rhenium.

An even more preferred composition of the present invention comprises from about 4 to about 16 percent by weight metal binder phase and from about 84 to about 96 percent by weight metal carbide. The metal carbide comprises about 4 to about 30 percent by weight of a transition metal carbide or mixtures thereof selected from Group IVB and Group VB of the Periodic Table of Elements and from about 70 to about 96 percent tungsten carbide. The metal binder phase comprises a major portion by weight nickel and from about 10 to about 25 percent by weight chromium.

The sintered composite of the present invention may include an effective amount of an additive for enhancing the uniformity of the corrosion resistance of the composite body. An anticorrosion agent is selected from the group consisting of copper, silver or tin may be present in the metal matrix of the final sintered composite to enhance the corrosion resistance of the composite. The anticorrosion agent is added in an effective amount sufficient to favorably improve the anticorrosion properties of the matrix material. Preferably the amount of anticorrosion agent by weight of the total composite is less than about one percent. When the anticorrosion agent is copper, the preferred amount is less than about 0.5 percent by weight. When the anticorrosion agent is silver, the preferred amount is less than about 0.5 percent by weight. When the anticorrosion agent is tin, the preferred amount is less than about 1.0 percent by weight.

The cemented carbide composition of the present invention may contain additional intentional additives or unintentional impurities less than an amount which may undesirably effect the desired microstructure hereinbefore mentioned. Additional intentional additives may be included to enhance certain properties. Additional metal carbides including the carbides of molybdenum and chromium may be present in the final composite and in particular in the solid solution carbide phase. Typical additional alloying agents with the binder phase include molybdenum, tungsten, and rhenium. Impurities may be present in the form of milling media which may be present as a separate grains in the final composite and as an impurity in the original ingredients. In the case of the metal binder, iron and cobalt are often present with nickel. Similarly, transition metals may be alloyed with the metal binder. Less than about 5 percent by weight and preferably less than about 1 percent by weight of the final sintered cemented carbide composite comprises additional ingredients in the form of impurities and intentional additives.

Preferably, the cemented carbide composition of the present invention comprises from about 85 to about 96 percent by weight metal carbide with about 20 to about 3.5 percent by weight of the metal carbide comprising a cubic metal carbide with the remaining metal carbide being tungsten carbide. Preferably, the matrix metal comprises from about 5 to about 30 percent by weight chromium, optionally up to about 0.5 percent by weight copper up to about 0.5 percent by weight silver, up to about 1 percent by weight tin addition with the remaining metal being nickel.

When preparing the cemented carbide composition of the present invention, a homogeneous mixture of starting powders are utilized. The various metal carbide ingredients and ingredients contributing to the composition of the metal matrix as hereinbefore referred to comprise an appropriate portion of the starting powder to result in the desired final composition of the cemented carbide composite as hereinbefore discussed. Nickel and alloys thereof may be used as a starting powder. Chromium may be present with the nickel as an alloy and mixed with the other powders prior to sintering. It is also contemplated that the chromium may be formed in the matrix material in situ. Carbides or other compositions containing chrome may be physically or chemically altered during sintering so that chromium content of the matrix is changed. The decomposition of chromium carbide during sintering will increase the amount of chrome in the matrix material. It is believed that this adjustment to the final composition is within the ordinary skill of one in the art. It is also contemplated that carbon or tungsten may be an appropriate addition to the starting powder mixture depending on the sintering conditions.

Typically, the starting powder has a mesh size less than 200 mesh, U.S. standard screen size. The metal carbide maY be sized by crushing to the proper size in a ball mill or by other conventional methods. In preparing the compositions of the present invention, the starting powders are thoroughly milled to give a uniform mixture of starting powders. Metal carbide powders and any ductile powders are typically mixed with a suitable organic binder to form a grade powder. The organic binder is selected to impart strength , typically referred to as green strength, to a cold compacted shape. Illustrative binders that are used include acetates, waxes and resins which are added to give green strength to a compact prior to sintering and to aid in pressing by a lubricating action. Paraffin type waxes which are insoluble in water are typically incorporated into grade powders by use of an organic solvent. Other techniques known in the art utilize water as a vehicle to introduce binders to give green strength. The organic solvent or water is removed by drying methods.

In preparing the sintered metal carbide of the present invention, the final powder mixture is introduced into a rigid mold cavitY. According to methods commonly employed in the art, the mold cavity is equipped with the pressure applying means. The pressure may be applied by a variety of means. However, hydraulic, pneumatic or mechanical pressure means are usually used in the form of a press, but other techniques such as extrusion are contemplated. Typical pressures usually range from 5 to 60 tons per square inch depending on the size and shape of the compact.

The resulting green part is sintered at temperatures and pressures known in the art to form a densified cemented carbide. Sintering is typically performed under conditions which result in near theoretical density and result in the metal binder forming a matrix between the grains of metal carbide. Typically, sintering is performed under vacuum conditions and at temperatures from about 1350 degrees to 1600 degrees Centigrade for a time of about 30 to 150 minutes. It is also contemplated that the mold cavity may be equipped with a heating means as is well known in the art such as an electrical resistance furnace or high frequency induction furnace. In this case, the pressure from the ram and the heat from the mold may be simultaneously applied to densify the grade powders.

EXAMPLE 1

A starting powder is prepared by mixing fine powders of the following ingredients which are set forth as a weight percent of the total mixture. A starting powder constitutes by weight 80.3 percent tungsten carbide, 3.5 percent titanium carbide, 7 percent tantalum carbide, 7 percent nickel, 2 percent chromium carbide, and 0.2 percent copper. The mixture is milled in a ball mill for 10 hours. After milling, the powder is mixed with a paraffin organic binder to impart green strength to a pressed compact. A portion of the mixture is placed in a die and the powder is pressed at a pressure of about 3000 pounds pr square inch to form a compact having green strength. The green compact is subsequent sintering at a temperature of about 1500 degrees Centigrade for about 60 minutes to form a test bar. The test bar is surface ground to the dimensions of $0.2\times0.25\times1$ inch. The microstructure of a polished and prepared sample is examined. The scanning electron micrograph at a magnification of 8000 times is similar to the micrograph illustrated in FIG. 1. The solid solution carbide forms a phase having tentacles or fingers extending at least partially through the composite. The tentacles or fingers are observed to extend closely adjacent the tungsten carbide grains and appear to replace at least a portion of the metal matrix which is normally found in this closely adjacent position. Corrosion tests are performed by immersing the bar in one of the following aqueous solutions for a one week period of time at an elevated temperature of 65 degrees Centigrade: 8.4 molar sodium hydroxide solution, 3.6 molar sulfuric acid solution, and 8.0 molar nitric acid solution. It is found that uniform results are obtained among the several samples tested. Consistently low corrosion is obtained with the samples tested. For the above mentioned respective corrosive solutions the weight loss for the respective test bars is as follows: 0.0001 grams, 0.0017 grams, and 0.0118 grams. The weight loss in nitric acid is measured after wiping off a soft surface formation.

EXAMPLE 2

In a manner similar to EXAMPLE 1, a test bar as constituted by the following proportions of starting powders is prepared. The starting powder constitutes by weight 80.5 percent tungsten carbide, 3.5 percent titanium carbide, 7 percent tantalum carbide, 7 percent nickel, and 2 percent chromium carbide. The SEM micrograph revealed a microstructure similar to the microstructure described with respect to EXAMPLE 1. Corrosion tests are performed by immersing the bar in the aqueous solutions discussed with respect to EXAMPLE 1. The corrosion tests are performed at both room and the elevated temperatures mentioned of 65 degrees Centigrade as mentioned in EXAMPLE 1. It is found that uniform results are obtained among the several samples tested. The weight loss in the room temperature test is 0.0004 grams in sodium hydroxide, 0.0005 grams in sulfuric acid, and 0.0001 grams in nitric acid. The weight loss in the elevated temperature test is 0.0001 gram in sodium hydroxide, 0.0018 grams in sulfuric acid, and 0.0116 grams in nitric acid. The weight loss in nitric acid is measured after wire brushing a soft surface off the substrate.

EXAMPLE 3

In a manner similar to EXAMPLE 1, a test bar as constituted by the following proportions of starting powders is prepared. The starting powder constitutes by weight 80.5 percent tungsten carbide, 3.5 percent titanium carbide, 7 percent tantalum carbide, 6.1 percent nickel, 1.4 percent molybdenum and 2 percent chromium carbide. The SEM micrograph revealed a microstructure similar to the microstructure described with respect to EXAMPLE 1. Corrosion tests are performed by immersing the bar in the aqueous solutions discussed with respect to EXAMPLE 1. The temperature of the aqueous solutions are at room temperature instead of the elevated temperatures mentioned in EXAMPLE 1. It is found that uniform results are obtained among the several samples tested. The weight loss is 0.0002 grams in sodium hydroxide, 0.0001 gram in sulfuric acid, and 0.0003 grams in nitric acid. The weight loss in nitric acid is measured after wire brushing a soft surface formation.

EXAMPLE 4

In a manner similar to EXAMPLE 1, a test bar as constituted by the following proportions of starting powders is prepared. The starting powder constitutes by weight 78.6 percent tungsten carbide, 3.5 percent titanium carbide, 7 percent tantalum carbide, 6.9 percent nickel, 1.8 percent molybdenum, 0.15 percent copper, 0.05 percent aluminum and 2 percent chromium carbide. The SEM micrograph revealed a microstructure similar to the microstructure described with respect to EXAMPLE 1. Corrosion tests are performed by immersing the bar in the aqueous solutions discussed with respect to EXAMPLE 1. The temperature of the aqueous solutions are at room temperature instead of the elevated temperatures mentioned in EXAMPLE 1. It is found that uniform results are obtained among the several samples tested. The weight gain is 0.0001 grams in sodium hydroxide and 0.0001 grams in nitric acid. The weight loss in sulfuric acid is 0.0001 grams. The weight change in nitric acid is measured after wiping off a soft surface off the substrate.

EXAMPLE 5

In a manner similar to EXAMPLE 1, a test bar as constituted by the following proportions of starting powders is prepared. The starting powder constitutes by weight 80.3 percent tungsten carbide, 3.5 percent titanium carbide, 7 percent tantalum carbide, 6.8 percent nickel, 0.2 percent copper, 0.2 percent tin and 2 percent chromium carbide. The SEM micrograph revealed a microstructure similar to the microstructure described with respect to EXAMPLE 1. Corrosion tests are performed by immersing the bar in the aqueous solutions discussed with respect to EXAMPLE 1. The temperature of the aqueous solutions are at the elevated temperature mentioned in EXAMPLE 1. It is found that uniform results are obtained among the several samples tested. The weight loss is 0.0001 grams in sodium hydroxide, 0.0020 grams in sulfuric acid, and 0.0109 grams in nitric acid. The weight loss in nitric acid is measured after wiping off a soft surface formation.

EXAMPLE 6

In a manner similar to EXAMPLE 1, a test bar as constituted by the following proportions of starting powders is prepared. The starting powder constitutes by weight 76.8 percent tungsten carbide, 3.4 percent titanium carbide, 6.9 percent tantalum carbide, 6.7 percent nickel, 0.2 percent copper, and 6 percent chromium carbide. The SEM micrograph revealed a microstructure similar to the microstructure described with respect to EXAMPLE 1. The corrosion test is performed by immersing the bar in the aqueous sulfuric acid solution at the elevated temperature as discussed with respect to EXAMPLE 1. The weight loss is 0.0026 gram in sulfuric acid.

EXAMPLE 7

In a manner similar to EXAMPLE 6, a test bar is constituted by 83.1 percent tungsten carbide, 3.6 percent titanium carbide, 7.2 percent tantalum carbide, 4 percent nickel and 2.1 percent chromium carbide. The corrosion test is performed by immersing the bar in the aqueous sulfuric acid solution as discussed with respect to EXAMPLE 6. The weight loss is 0.0019 gram in sulfuric acid.

EXAMPLE 8

In a manner similar to EXAMPLE 6, a test bar is constituted by 72.9 percent tungsten carbide, 7.2 percent titanium carbide, 4.4 percent tantalum carbide, 3.5 percent nickel, 0.2 percent copper and 1.8 percent chromium carbide. The corrosion test is performed by immersing the bar in the aqueous sulfuric acid solution as discussed with respect to EXAMPLE 6. The weight loss is 0.0011 gram in sulfuric acid.

EXAMPLE 9

In a manner similar to EXAMPLE 6, a test bar is constituted by 79.5 percent tungsten carbide, 3.5 percent titanium carbide, 6.9 percent tantalum carbide, 1 percent niobium carbide, 6.9 percent nickel, 0.2 percent copper and 2 percent chromium carbide. The corrosion test is performed by immersing the bar in the aqueous sulfuric acid solution as discussed with respect to EXAMPLE 6. The weight loss is 0.0013 gram in sulfuric acid.

COMPARISON EXAMPLE

In a manner similar to EXAMPLE 1, test bars not exhibiting the microstructure according to the present invention and as constituted by the following proportions of starting powders are prepared. Corrosion tests are performed by immersing the respective test bars in the aqueous solutions discussed with respect to EXAMPLE 3. As a general observation, the rate of corrosion is considerably higher for the test bars not having the composition of the present invention. A test bar constituting a starting powder comprising by weight 95.5 percent tungsten carbide, 1.5 percent titanium carbide, 2.5 percent tantalum carbide and 0.5 percent cobalt is prepared. The weight gain in sulfuric acid is 0.0005 gram. The weight loss is 0.0006 grams in sodium hydroxide and 0.0067 grams in nitric acid. A test bar Constituting a starting powder comprising by weight 93.7 percent tungsten carbide, 0.1 percent vanadium carbide, 1 percent chromium and 5.2 percent cobalt. The weight loss is 0.0067 grams in sodium hydroxide, 0.0420 grams in sulfuric acid, and 0.0007 grams in nitric acid after wiping off a soft surface formation. A test bar constituting a starting powder comprising by weight 94 percent tungsten carbide and 6 percent nickel is prepared. The weight gain is 0.0003 gram in sodium hydroxide, 0.0010 gram in sulfuric acid. The weight loss in nitric acid is 0.0003 gram. The temperature of the aqueous solutions are at room temperature. For purpose of comparison, the weight loss in the nitric acid solution is considerably greater for the compositions not in accordance with the present invention. For purposes of comparison at elevated temperatures, for the test bar constituting a starting powder comprising by weight 94 percent tungsten carbide and 6 percent nickel, the weight gain is 0.0002 gram in sodium hydroxide. The weight loss is 0.0194 gram in sulfuric acid and 0.0637 gram in nitric acid after stripping off a soft formation. For purposes of another comparison at elevated temperatures, for the test bar constituting a starting powder comprising by weight 96.7 Percent tungsten carbide, 0.3 percent tantalum carbide and 3 percent cobalt, the weight loss is 0.1212 gram in sulfuric acid and 0.0989 gram in nitric acid after stripping off a soft formation. The elevated corrosion test supported the improved corrosion resistance of the compositions of the present invention.

What is claimed is:

1. A corrosion resistant cemented carbide composite comprising a granular tungsten carbide phase, a semi-continuous solid solution carbide phase extending closely adjacent at least a portion of said grains of tungsten carbide for enhancing corrosion resistance, and a substantially continuous metal binder phase, said cemented carbide composite consisting essentially of an effective amount of an anti-corrosion additive, from about 4 to about 16 percent by weight metal binder phase, and with the remaining portion being from about 84 to about 96 percent by weight metal carbide wherein said metal carbide consists essentially of from about 4 to about 30 percent by weight of a transition metal carbide or mixtures thereof selected from Group IVB and Group VB of the Periodic Table of Elements and from about 70 to about 96 percent tungsten carbide, said metal binder phase consists essentially of nickel and from about 10 to about 25 percent by weight chromium, said effective amount of an anti-corrosion additive being selected from the group consisting essentially of copper, silver, tin and combinations thereof.

2. A corrosion resistant cemented carbide composite according to claim 1 wherein said anticorrosion agent comprises less than about 0.5 weight percent copper based on the total weight of said constituents.

3. A corrosion resistant cemented carbide composite according to claim 1 wherein said anticorrosion agent comprises less than about 1 weight percent silver based on the total weight of said constituents.

4. A corrosion resistant cemented carbide composite according to claim 1 wherein said anticorrosion agent comprises less than about 1 weight percent tin based on the total weight of said constituents.

5. A corrosion resistant cemented carbide composite according to claim 1 wherein said semi-continuous solid solution carbide phase is a randomly oriented and irregularity shaped phase.

6. A corrosion resistant cemented carbide composite according to claim 1 wherein said transition metal carbide agent comprises titanium carbide and tantalum carbide.

7. A corrosion resistant cemented carbide composite according to calim 1 wherien said transition metal carbide comprises titanium carbide and tantalum carbide and additional amounts of transition metal carbides other than said titanium carbide and tantalum carbide for enhancing the microstructure of said cemented carbide composite.

8. A corrosion resistant cemented carbide composite according to claim 7 wherein said additional amounts of transition metal carbides other than said titanium carbide and tantalum carbide comprises vanadium carbide.

9. A corrosion resistant cemented carbide composite according to claim 8 wherein said vanadium carbide is present in an amount less than about 2 percent by weight based on the weight of the total composite.

10. A corrosion resistant cemented carbide composite according to claim 7 wherein said additional amounts of transition metal carbides other than said titanium carbide and tantalum carbide comprises tantalum carbide.

11. A corrosion resistant cemented carbide composite according to claim 8 wherein said tantalum carbide is present in an amount less than about 1 percent by weight based on the weight of the total composite.

* * * * *